US005473356A

United States Patent [19]

Nisius et al.

[11] Patent Number: 5,473,356

[45] Date of Patent: Dec. 5, 1995

[54] METHOD OF COMPENSATING FOR RESISTANCE TOLERANCES IN PRINTING A MULTI-TONE PICTURE

[75] Inventors: Raimund Nisius; Friedrich-Wilhelm Drees, both of Berlin, Germany

[73] Assignee: Eastman Kodak Company, Rochester, N.Y.

[21] Appl. No.: 950,269

[22] Filed: Sep. 23, 1992

[30] Foreign Application Priority Data

Sep. 23, 1991 [DE] Germany ..... 41 32 094.8

[51] Int. Cl.[6] ..... B41J 2/37

[52] U.S. Cl. ..... 347/191; 347/183

[58] Field of Search ..... 346/76 PH; 358/298; 400/120, 120.07; 347/183, 191

[56] References Cited

U.S. PATENT DOCUMENTS 4,806,949 2/1989 Onuma et al. ..... 346/76 PH 4,887,092 12/1989 Pekruhn et al. ..... 346/76 PH

FOREIGN PATENT DOCUMENTS

3820927A1 1/1989 Germany .

4025793C2 5/1992 Germany .

*Primary Examiner*—Huan H. Tran

*Attorney, Agent, or Firm*—Cohen, Pontani, Lieberman & Pavane

[57] ABSTRACT

A method of compensating for resistance tolerances in the printing of a multi-tone picture with a printing device which includes printing elements. Starting from a smaller number of required tone grades than the number of available tone grades, represented by energy values, printing is always effected with those available tone grades whose available optical density comes close to the required optical density. The differences between the required optical density and actually available optical density are added to form a mean deviation whose magnitude is minimized by selecting the corresponding available tone grade so that the created visual picture has the required optical density.

13 Claims, 2 Drawing Sheets

METHOD OF COMPENSATING FOR RESISTANCE TOLERANCES IN PRINTING A MULTI-TONE PICTURE

BACKGROUND OF THE INVENTION

1. Field of the Invention

The present invention relates to a method of compensating for the resistance tolerances when printing a multi-tone picture or image with a printing device having printing elements which are arranged in a row. The method is particularly suitable for thermal printing recording devices in which ink particles are transferred onto or into a recording medium from an ink ribbon.

2. Description of the Related Art

In a printing device with multi-tone reproduction, recording dam are generally converted into printing pulses having a pulse width corresponding to the tone grades for supplying to suitable heating resistors. This process controls the proportion of toner transferred from a toner film to give a recording of desired density. The heating resistors are heated to selected temperatures by supplying print pulses based on the tone data. However, when differences exist in the resistance values between the heating resistors, the heating resistors are heated to different temperatures, even if their print pulses are supplied at the same pulse width. As a result, the recorded picture shows irregularities in density and accordingly a poor-quality recording.

However, such differences in the resistance value of the heating resistors are unavoidable side-effects to some extent, since it is difficult to design in a uniform manner the resistance values of the number of heating resistors arranged in a line. Under these conditions, a mean resistance value is given for all heating resistors of the thermal head.

It is further known that heating resistors deteriorate and the resistance values increase over the course of time. If no steps are taken in the thermal head or in the housing of the recording device to compensate for the deterioration of the heating resistors, the thermal head is no longer usable when the resistance value increases by approximately 10%.

A thermal printing recording device with multi-tone reproduction is known from DE 38 20 927. In addition to a thermal head with a number of heating resistors arranged in a row, means are provided for measuring the resistance of each individual heating element and a compensating storage for storing information which is used to compensate for tone data and indicates the tone grades of points or dots to be recorded as a function of the resistance values of the heating resistors for recording the dots. The information stored in the compensation storage varies with the resistance values measured at selected times by the measuring device. The means for driving the heating resistors are suitable for referring to the information stored in the compensation storage.

The compensation storage can be constructed for storing compensation data for determining the pulse width to be supplied to each of the heating resistors from the resistance value of every heating resistor and the tone grades indicated by the tone data. Although this multi-tone recording device is capable of reacting immediately to all changes with respect to the heating resistors of the thermal head, the device is very expensive, and additional time is required between the individual printing processes to detect the resistance. Accordingly the printing process is lengthened, which is undesirable particularly with high resolutions.

The compensation principle implemented in the known multi-tone recording device principally aims at producing every optical density desired on the recording carrier in accordance with the picture data by means of analog-valent ink transfer.

A method of printing a half-tone picture in which a plurality of grade values is generated from a small number of required tone grades by means of a reference pattern allocation or assignment is known from DE 40 25 793.2.

SUMMARY OF THE INVENTION

Therefore, it is the primary object of the present invention to compensate for optional resistance tolerances of thermoelectric printing elements in a printing device for printing a multi-tone picture with minimal continuous operating expenditures.

In accordance with the present invention, with a predetermined number of tone grades of desired optical density and a larger number of physically available tone grades, every dot is printed with the printing grade whose respective available optical density specific to the resistance comes closest to the desired optical density, and the deviation of the available optical density from the desired optical density is compensated for with the inclusion of an immediately neighboring physically available tone grade in such a way that the mean value of the actual optical density of consecutive printing dots corresponds to the desired optical density.

In accordance with a further development of the invention, a number of consecutive resistance ranges are predetermined once in such a way that the resolution, with reference to the nominal value of the resistances, reliably falls below the resolution capacity of the human eye. The resistance value of each printing element is measured and every printing element is associated with one of the resistance ranges. A value is assigned to every required optical density and to every available optical density. The difference between the value of the required optical density and the value of the actually available optical density is defined as a mean deviation for each printing element.

The corresponding available tone grade is selected cyclically for each dot to be printed as a function of the actual value of the mean deviation and the mean deviation is determined for the following print dot.

In a further development of the invention, the actual mean deviation and the value of the desired optical density are added and this sum is compared with the value of the desired optical density.

In a further step, printing is effected with the available tone grade whose available optical density just falls below the desired optical density when the sum is smaller and otherwise just exceeds the desired optical density.

In another development of the invention, printing is effected with the available tone grade whose available optical density is at most equal to the sum of the mean deviation of the present printing step and the desired optical density.

In a further development of the invention, the mean deviation for the following print dot is determined from the sum reduced by the value of the available optical density with whose respective tone grade the actual dot is printed.

Thus, the invention is based on a deliberate utilization of the integrating behavior of the human eye caused by insufficient resolution by forming an optical mean value corresponding to the desired tone grade for every desired quasi-analog tone grade by means of deliberate alternative activation of two consecutive available tone grades. In an advantageous manner, only a small number of quantized tone grades whose long-term reproducibility can be ensured by additional steps are required in order to implement this method. For this purpose, the printing elements are preferably pre-aged before being measured by applying a predetermined number of print pulses to the printing element.

Moreover, all measuring means and means for processing the measurement values in the device can be dispensed with, so that the device is less expensive.

Further, the printing process is not interrupted by measurement cycles so that a higher output of recorded material per unit of time is achieved.

The value of the mean deviation is advantageously carried over when changing tone grades within a line to be printed by a printing element so as to achieve the desired edge contrast.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DESCRIPTION OF THE PREFERRED EMBODIMENTS

In the following, the application of the invention to a thermal printing device is discussed. Based on the known fact that the majority of thermoelectric printing elements of a given thermal head have a common nominal resistance, but more or less high resistance tolerances depending on the production quality, the resulting consequences on the print quality are as follows.

Figure 1:
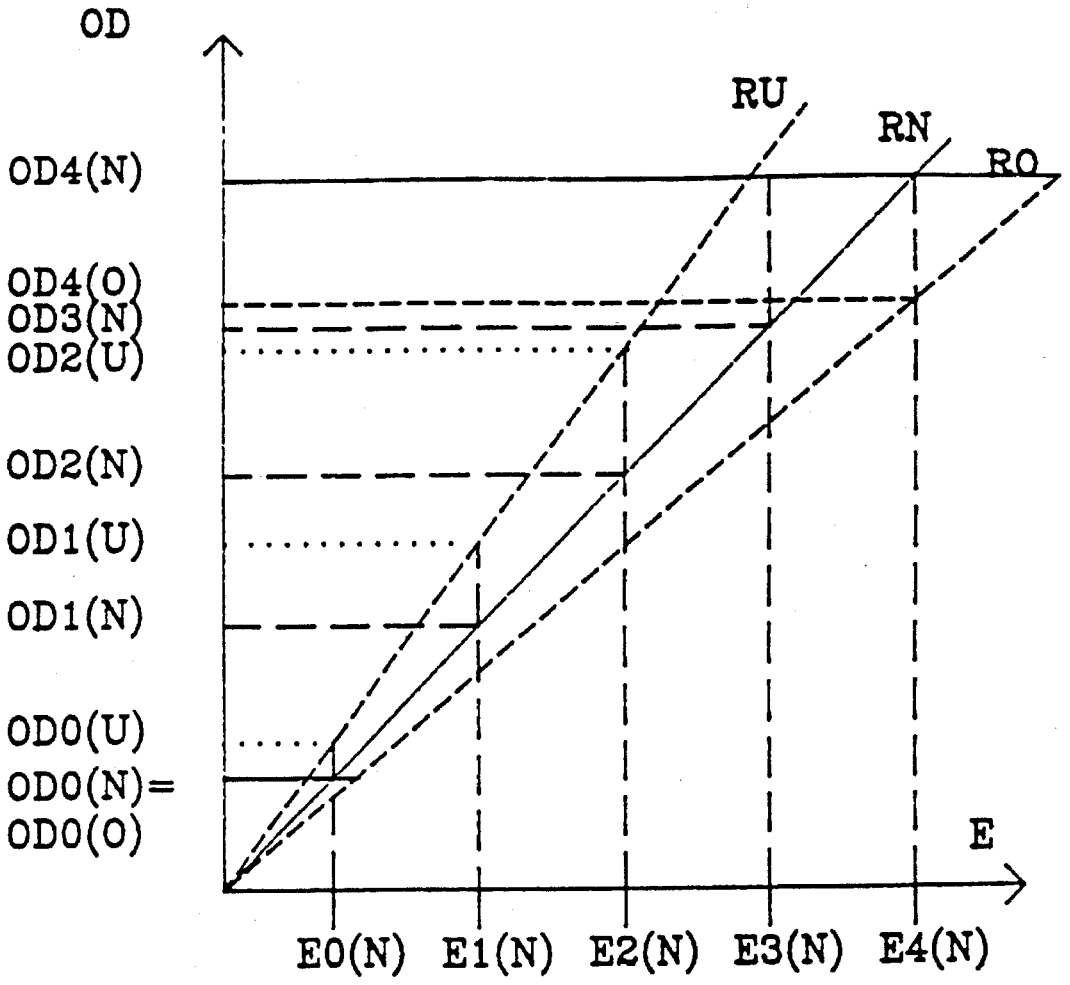
FIG. 1 is a graph illustrating the relationship between the optical density and the supplied energy as a function of the resistance of the heating element.

FIG. 1 shows a coordinate system in which energy values E, which are proportional to the heating time of the corresponding printing element with reference to the resistance, are plotted on the abscissa. The respective values of the optical density OD are plotted on the ordinate. Three resistance characteristic lines RU, RN and RO are shown in the coordinate system. Characteristic line RN shows the nominal resistance of all printing elements of the thermal head. The characteristic line designated by RU represents the resistance value of the lower tolerance limit and characteristic line RO shows the resistance value of the upper tolerance limit.

The following considerations with respect to characteristic line RN of the nominal resistance, refer to five tone grades, represented by 5 grades of the respective optical density OD0(N) to OD4(N). It is known that the temperature of the printing element starting from energy value "0" to an energy value E0(N) for characteristic line RN is not sufficient to enable ink transfer; this corresponds to the threshold value of the optical density OD0(N). An increased energy supply up to energy value EA(N) leads to an essentially linear increase in the optical density up to grade OD4(N). A supply of energy above this can no longer be converted into increasing optical density; saturation behavior is present.

Three further grades of optical density OD1(N) to OD3(N) are defined in uniform distribution between the threshold value of the optical density OD0(N) and the saturation value of the optical density OD4(N), and the energy values E1(N) to E3(N) required to produce them are indicated for the characteristic line RN of the nominal resistance.

It is apparent from FIG. 1 that the saturation value of the optical density OD3(N)=OD4(N) is already achieved for a printing element whose resistance meets the conditions of the lower tolerance limit and which accordingly is to be associated with the characteristic line RU and supplied with energy value E3(N) for producing the optical density OD3(N). This means that only four of the required five grades of optical density OD0(U) to OD3(U) which conform to the required grades of optical density OD0(N) to OD4(N) only at the threshold value OD0(U)=OD0(N) and at the saturation value OD3(U)=OD4(N) are available for printing elements whose resistance values are to be assigned to the characteristic line RU.

FIG. 1 further shows that the saturation value is not reached for a printing element whose resistance meets the conditions of the upper tolerance limit and which is accordingly associated with the characteristic line RO and to which the energy value E4(N) is fed for producing the optical density OD4(N), but rather an available optical density OD4(O) is reached which, with respect to magnitude, corresponds to the required optical density OD3(N).

According to the invention, for a number m of physically available tone grades, e.g. m=15, represented by the discrete energy values E1 to E15, the number n of required tone grades TS1 to TS5 associated with a required optical density OD(TS1) to OD(TS5) is limited, for example, to n=5.

Further, a number k of resistance ranges is provided in such a way that the entire tolerance field of possible resistances is covered in a uniform manner. For k=50 resistance ranges, for example, there results for thermal heads whose printing elements have tolerances up to ±20% with reference to the nominal resistance a resolution of each individual resistance range of less than 1% with reference to the nominal value and accordingly a maximum 1% deviation within every grade of optical density. It is known that deviations of the optical density in the order of magnitude of 1% can no longer be perceived by the human eye and appear uniform.

Figure 2:
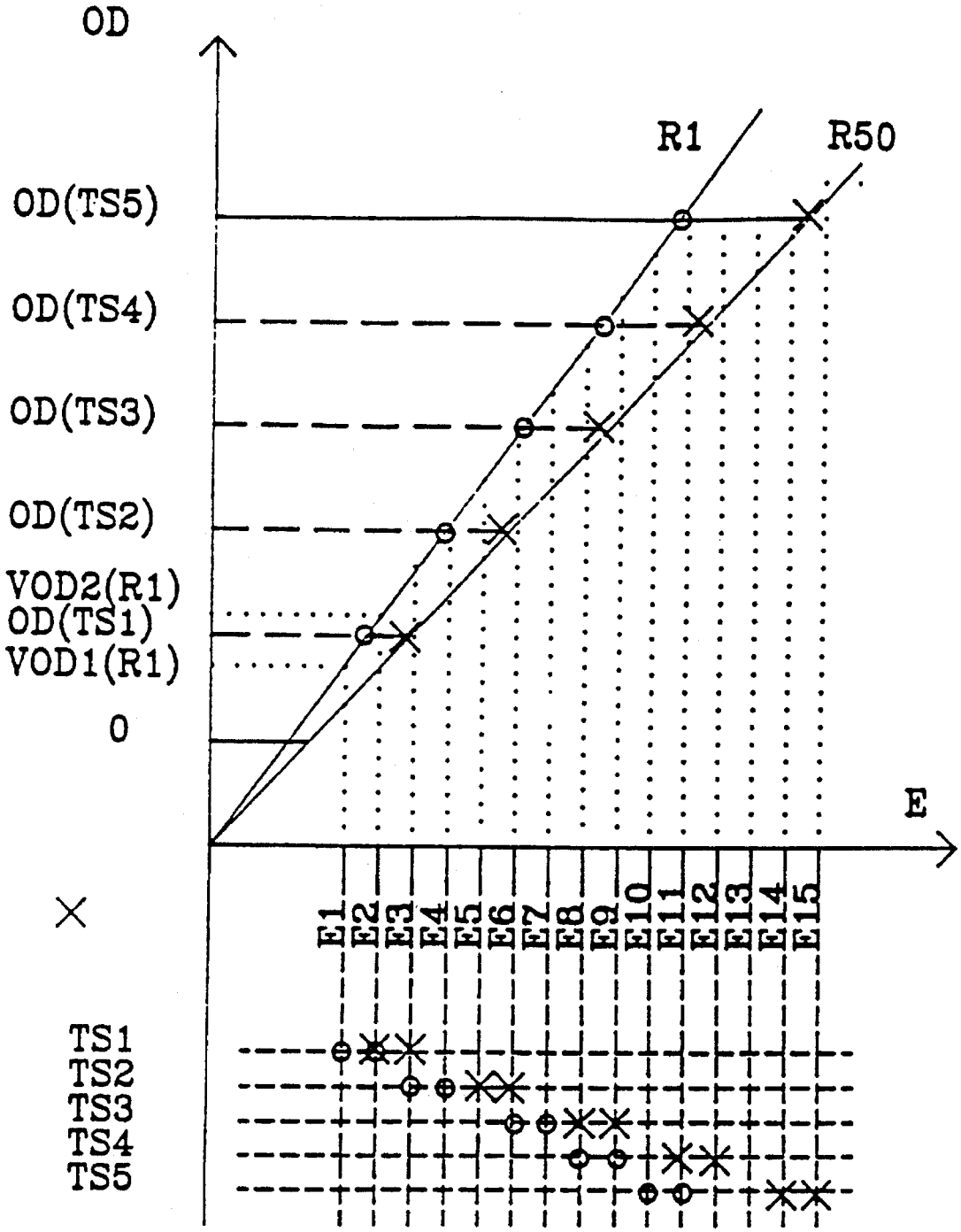
FIG. 2 is a graph illustrating the relationship between the available tone grade and the desired tone grade as a function of the optical density and the maximum resistance tolerances.

For the sake of clarity, FIG. 2 shows only the characteristic lines R1 and R50 of two resistance ranges which represent the lower tolerance limit, characteristic line R1, and the upper tolerance limit, characteristic line R50. Characteristic lines R2 to R49 of the other k–2 resistance ranges would be arranged between the indicated characteristic lines R1 and R50. The characteristic line R1 in FIG. 2 accordingly corresponds to the characteristic line RU in FIG. 1 and the characteristic line R50 in FIG. 2 corresponds to the characteristic line RO in FIG. 1.

The available optical density VOD is determined and tabulated for each energy value E1 to E15 for every resistance range R1 to R50. According to the first quadrant of FIG. 2, for example, the available optical density VOD1(R1) is precisely that which results when a printing element belonging to the resistance range of characteristic line R1 is acted upon by the energy value E1 and the available optical density VOD2(R1) is precisely that corresponding to the energy value E2 in the same resistance range.

As can be seen, the available optical density VOD2(R1) is just greater than the required optical density OD(TS1) and the available optical density VOD1(R1) falls just below the desired optical density OD(TS1). Consequently, printing elements which belong to the resistance range of characteristic line R1 are acted upon alternately by energy values E1 and E2 for producing print dots of optical density OD(TS1). This relationship is indicated in the fourth quadrant in FIG. 2 with reference to the required tone grade TS1 by two points at the intersections of the lines for energy values E1 and E2 and the line for the required tone grade TS1.

Thus, as follows from FIG. 2, it is always possible to indicate two successive energy values En and En+1(0<n<15) which alternately act upon the given printing element in a suitable manner for realizing one of the required tone grades TS1 to TS5. These energy values are indicated e.g. by circles on the corresponding intersections for printing elements whose resistances belong to the characteristic line R1 and by crosses for printing elements whose resistances belong to the characteristic line R50. The assignment of the required tone grades TS1 to TS5 to the energy values E1 to E15 is likewise determined and tabulated for every resistance range.

As shown in FIG. 2, by way of example, the required optical density OD(TS1) is not equal to the mean value of the next available optical densities VOD1(R1) and VOD2(R1). A mean deviation MWA is defined for each printing element in order to achieve exactly the required optical density OD(TS1) on the average. The initial value of this mean deviation MWA(0) is equal to zero. Whereas all other magnitudes contingent on the method are defined once and then remain constant, the actual mean deviation MWA(x) for the printing step x is the only quantity continuously updated. The mean deviation MWA(x+1) for the following printing step x+1 results from the sum of the mean deviation MWA(x) of the actual printing step x and the value of the actually desired optical density VOD(x) reduced by the value of the available optical density whose respective tone grade is actually printed.

In a first embodiment, with a negative actual mean deviation MWA(x), printing is effected with the available tone grade whose available optical density VOD just exceeds the required optical density ROD. By way of example, the sequence of the first twelve printing steps x may be as follows:

| MWA (0) = 0 | ROD = 13,3 | | | | | VOD = 13,14 | | | | | | |
|---|---|---|---|---|---|---|---|---|---|---|---|---|
| x | 1 | 2 | 3 | 4 | 5 | 6 | 7 | 8 | 9 | 10 | 11 | 12 |
| MWA (x −1) + ROD | 13.6 | 12.6 | 12.9 | 13.2 | 13.5 | 12.8 | 13.1 | 13.4 | 12.7 | 13.0 | 13.3 | 12.6 |
| VOD | 14 | 13 | 13 | 13 | 14 | 13 | 13 | 14 | 13 | 13 | 14 | 13 |
| MWA (x) | −0.7 | −0.4 | −0.1 | +0.2 | −0.5 | −0.2 | +0.1 | −0.6 | −0.3 | 0 | −0.7 | −0.4 |

The available optical densities OD immediately neighboring values 13 and 14 corresponding to the energy values E13 and E14 result for a required optical density ROD which is assigned the value 13.3. The resulting sequence of available optical density values for the first ten printing steps x is 14/13/13/13/14/13/13/14/13/13. After the tenth printing step x, the mean deviation MWA(10) is 0; then a new cycle with the same sequence begins. The mean value of the achieved optical density MWO is:

$$MWO = \frac{14+13+13+13+14+13+13+14+13+13}{10} = 13.3$$

and is accordingly equal to the agreed required optical density VOD.

In another embodiment, printing is always effected with the available tone grade whose respective available optical density VOD has a value which comes closest to the actually required optical density ROD(x) and is, at most, equal to the sum of the mean deviation MWA(x−1) of the preceding printing step and the actually required optical density ROD(x). The first twelve printing steps run as follows with the same initial quantities as in the first embodiment example:

| x | 1 | 2 | 3 | 4 | 5 | 6 | 7 | 8 | 9 | 10 | 11 | 12 |
|---|---|---|---|---|---|---|---|---|---|---|---|---|
| MWA (x − 1) + ROD | 13.3 | 13.6 | 13.9 | 14.2 | 13.5 | 13.8 | 14.1 | 13.4 | 13.7 | 14.0 | 13.3 | 13.6 |
| VOD | 13 | 13 | 13 | 14 | 14 | 13 | 14 | 13 | 13 | 14 | 14 | 13 |
| MWA (x) | 0.3 | 0.6 | 0.9 | 0.2 | 0.5 | 0.8 | 0.1 | 0.4 | 0.7 | 0 | 0.3 | 0.6 |

The successive sequence of available optical density values VOD for the first ten printing steps x is 13/13/13/14/13/13/14/13/13/14. After the tenth printing step x the mean deviation MWA(10) is, as expected, equal to zero also in this embodiment and a new cycle begins. The mean value of the achieved optical density MWO is:

$$MWO = \frac{13+13+13+14+13+13+14+13+13+14}{10} = 13.3$$

and is accordingly equal to the agreed required optical density VOD.

It can be seen in both embodiments that the successive sequence of divergent available optical density values 13 and 14 is uniformly distributed over a cycle according to the invention. As a result, with a print dot resolution of e.g. 300 dpi, a visual image is formed which gives the impression of a completely uniform optical density and accordingly satisfies the required high demands with respect to quality.

In carrying out the method, the following work sequence results for a specific printing head. First, all printing elements are pre-aged by being acted upon by a predetermined number of print pulses. Next, all printing elements of a printing head are measured externally from the device. Every printing dement is assigned to one of k predetermined resistance ranges and this assignment is tabulated. Both the records contingent on the method and those specific to the printing head are implemented when the printing head is assembled inside the device.

It should be understood that the preferred embodiments and examples described are for illustrative purposes only and are not to be construed as limiting the scope of the present invention which is properly delineated only in the appended claims.

We claim:

1. A method of compensating for resistance variations in printing elements in a printing head for the printing of dots to obtain a multi-tone picture, said printing elements being arranged in a row and said printing elements using a predetermined number m of tone grades of desired optical density taken from a number n of physically available tone grades in which n>m, the method comprising the steps of printing every dot with a tone grade whose available optical density specific to the printing element resistance is closest to the desired optical density, and compensating for the deviation of the available optical density from the desired optical density by combining the desired optical density with the deviation of the available optical density for a directly neighboring physically available tone grade, such that a mean value of the actual optical density of consecutive dots corresponds to the desired optical density; further comprising the steps of (a) predetermining a number k of successive resistance ranges such that the resolution thereof, with reference to the nominal value of resistance, reliably falls below the resolution capacity of the human eye, (b) measuring a resistance value of each printing element, (c) assigning each printing element to one of the k resistance ranges, (d) assigning a value to each required optical density and to each available optical density, (e) defining the difference between the values of the required optical density and the actually available optical density as a mean deviation for every printing element, wherein steps (a) to (e) are each carried out once, (f) selecting one of the available tone grades whose optical density neighbors the required optical density for each dot to be printed as a function of the actual value of the mean deviation, and (g) determining the mean deviation for the following print dot, wherein steps (f) and (g) are carried out cyclically.

2. The method according to claim 1, comprising forming a sum of a preceding mean deviation and the value of the actually desired optical density and comparing this sum with the value of the actually desired optical density.

3. The method according to claim 2, comprising one of printing with an available tone grade whose available optical density just falls below the desired optical density when the sum is smaller than the actually available optical density and printing with an available tone grade whose available optical density just exceeds the desired optical density when the sum is greater than the actually available optical density.

4. The method according to claim 3, comprising determining a mean deviation for a following print dot from the sum reduced by the value of the available optical density by means of whose corresponding tone grade the actual print dot is printed.

5. The method according to claim 2, comprising printing with the available tone grade whose available optical density is at most equal to the sum.

6. The method according to claim 1, comprising pre-aging all printing elements of each printing head uniformly.

7. A method of compensating for resistance variations in printing elements arranged in a row in a printing head for the printing of dots to form a multi-tone picture, said method comprising the steps of:

defining a predetermined number m of tone grades of desired optical density to be printed and taken from a number n of physically available tone grades in which n>m;

printing each dot with a physically available tone grade whose optical density specific to the printing element resistance is closest to the desired optical density;

compensating for a deviation of the available tone grade optical density of said each dot from the desired optical density by printing an immediately-adjacent dot with a selected immediately neighboring physically available tone grade; and printing each subsequent immediately-adjacent dot using a physically available tone grade selected to compensate for the deviation of the available optical density of an immediately preceding dot from the desired optical density;

the physically available tone grade and the tone grade of the subsequent immediately-adjacent dot being selected so that a mean value of the printed physically available optical densities of a consecutive plurality of said dots corresponds to the desired optical density.

8. The method according to claim 7, further comprising the steps of (a) predetermining a number k of successive resistance ranges such that the resolution thereof, with reference to the nominal value of resistance, reliably falls below the resolution capacity of the human eye, (b) measuring a resistance value of each printing element, (c) assigning each printing element to one of the k resistance ranges, (d) assigning a value to each required optical density and to each available optical density, (e) defining the difference between the values of the required optical density and the actually available optical density as a mean deviation for every printing element, wherein steps (a) to (e) are each carried out once, (f) selecting one of the available tone grades whose optical density neighbors the required optical density for each dot to be printed as a function of the actual value of the mean deviation, and (g) determining the mean deviation for the following print dot, wherein steps (f) and (g) are carried out cyclically.

9. The method according to claim 8, further comprising forming a sum of a preceding mean deviation and the value of the actually desired optical density and comparing this sum with the value of the actually desired optical density.

10. The method according to claim 9, further comprising one of printing with an available tone grade whose available optical density just falls below the desired optical density when the sum is smaller than the actually available optical density and printing with an available tone grade whose available optical density just exceeds the desired optical density when the sum is greater than the actually available optical density.

11. The method according to claim 10, further comprising determining a mean deviation for a following print dot from the sum reduced by the value of the available optical density by means of whose corresponding tone grade the actual print dot is printed.

12. The method according to claim 9, further comprising printing with the available tone grade whose available optical density is at most equal to the sum.

13. The method according to claim 7; further comprising pre-aging all printing elements of each printing head uniformly.

* * * * *

UNITED STATES PATENT AND TRADEMARK OFFICE

CERTIFICATE OF CORRECTION

PATENT NO. : 5,473,356

DATED : December 5, 1995

INVENTOR(S) : Raimund Nisius, et al.

It is certified that error appears in the above-indentified patent and that said Letters Patent is hereby corrected as shown below:

Column 8, line 4, after "claim" delete "1" and insert --2--.

Signed and Sealed this

Eighteenth Day of June, 1996

Bruce Lehman

*Attest:*

BRUCE LEHMAN

*Attesting Officer*

*Commissioner of Patents and Trademarks*